US011630407B2

(12) United States Patent
Nanai

(10) Patent No.: US 11,630,407 B2
(45) Date of Patent: Apr. 18, 2023

(54) ELECTRONIC APPARATUS WHICH CONTROLS POWER TO A MOTOR FROM TWO DIFFERENT POWER SUPPLIES

(71) Applicant: CANON KABUSHIKI KAISHA, Tokyo (JP)

(72) Inventor: Ryosuke Nanai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/028,893

(22) Filed: Sep. 22, 2020

(65) Prior Publication Data

US 2021/0096491 A1 Apr. 1, 2021

(30) Foreign Application Priority Data

Sep. 30, 2019 (JP) ..... JP2019-180373

(51) Int. Cl.
*G03G 15/00* (2006.01)

(52) U.S. Cl.
CPC ..... *G03G 15/5004* (2013.01); *G03G 15/5045* (2013.01)

(58) Field of Classification Search
CPC ..... G03G 15/5004; G03G 15/5045; G03G 21/20; G03G 21/206
See application file for complete search history.

(56) References Cited

U.S. PATENT DOCUMENTS

2004/0000886 A1* 1/2004 Yun ..... G03G 15/205 318/268
2008/0166110 A1* 7/2008 Chen ..... H02P 7/285 388/828
2009/0283958 A1* 11/2009 Takahashi ..... B65H 3/48 271/12
2020/0101775 A1* 4/2020 Kobayashi ..... B41J 11/007
2021/0096490 A1* 4/2021 Morishita ..... G03G 21/206

FOREIGN PATENT DOCUMENTS

JP 2007142047 A 6/2007
JP 2010262123 A * 11/2010

OTHER PUBLICATIONS

Machine translation of JP2010262123 (Year: 2010).*

* cited by examiner

*Primary Examiner* — Roy Y Yi
*Assistant Examiner* — Andrew V Do
(74) *Attorney, Agent, or Firm* — Canon U.S.A., Inc. I.P. Division

(57) ABSTRACT

An image forming apparatus which includes a motor, a first power supply unit that supplies a first voltage to the motor, and a second power supply unit that supplies a second voltage, which is higher than the first voltage, to the motor, and a central processing unit (CPU) that controls supply of the second voltage from the second power supply unit to the motor while maintaining supply of the first voltage from the first power supply unit to the motor.

13 Claims, 8 Drawing Sheets

ELECTRONIC APPARATUS WHICH CONTROLS POWER TO A MOTOR FROM TWO DIFFERENT POWER SUPPLIES

BACKGROUND

Field of the Disclosure

The present disclosure generally relates to an electronic apparatus including a motor.

Description of the Related Art

An image forming apparatus such as an electrophotographic copying machine keeps a photosensitive drum at a constant temperature by controlling a fan motor in the apparatus, because image quality can be maintained by keeping the photosensitive drum at a constant temperature. Japanese Patent Application Laid-Open No. 2007-142047 discusses a technology of rotating a fan at a low speed during standby and at a high speed during activation of a main control unit. According to Japanese Patent Application Laid-Open No. 2007-142047, a fan unit is configured to be supplied with a plurality of voltages (12 V and 5 V), and is supplied with 5 V during the standby and 12 V during the activation of the main control unit.

In the method of Japanese Patent Application Laid-Open No. 2007-142047, however, a fan motor can be rotated only at two speeds of a low speed and a high speed, because the fan unit is only supplied with either 5 V or 12 V. In other words, in Japanese Patent Application Laid-Open No. 2007-142047, the fan motor cannot be rotated at a speed between the low speed and the high speed.

Although not discussed in Japanese Patent Application Laid-Open No. 2007-142047, it is conceivable that the fan unit may be supplied with a voltage between 5 V and 12 V by decreasing 12 V to be output from a power unit, using a direct current to direct current (DC-DC) converter circuit. It is also conceivable that the fan unit may be supplied with a voltage between 5 V and 12 V by increasing 5 V to be output from a digital-digital converter (DDC), using a DC-DC converter circuit.

However, adding a DC-DC converter circuit in such a manner may lead to an increase in circuit cost and an increase in circuit mounting area.

SUMMARY

According to an aspect of the present disclosure, an electronic apparatus includes a motor, a first power supply unit configured to supply a first voltage to the motor, a second power supply unit configured to supply a second voltage higher than the first voltage to the motor, and a processor configured to control the starting and stopping of the supply of the second voltage from the second power supply unit to the motor, while maintaining supply of the first voltage from the first power supply unit to the motor.

Further features of the present disclosure will become apparent from the following description of exemplary embodiments with reference to the attached drawings.

DESCRIPTION OF THE EMBODIMENTS

Embodiments of the present disclosure will be described with reference to the drawings. Here, an image forming apparatus having a print function will be described as an example of an electronic apparatus.

First Exemplary Embodiment

Figure 1:
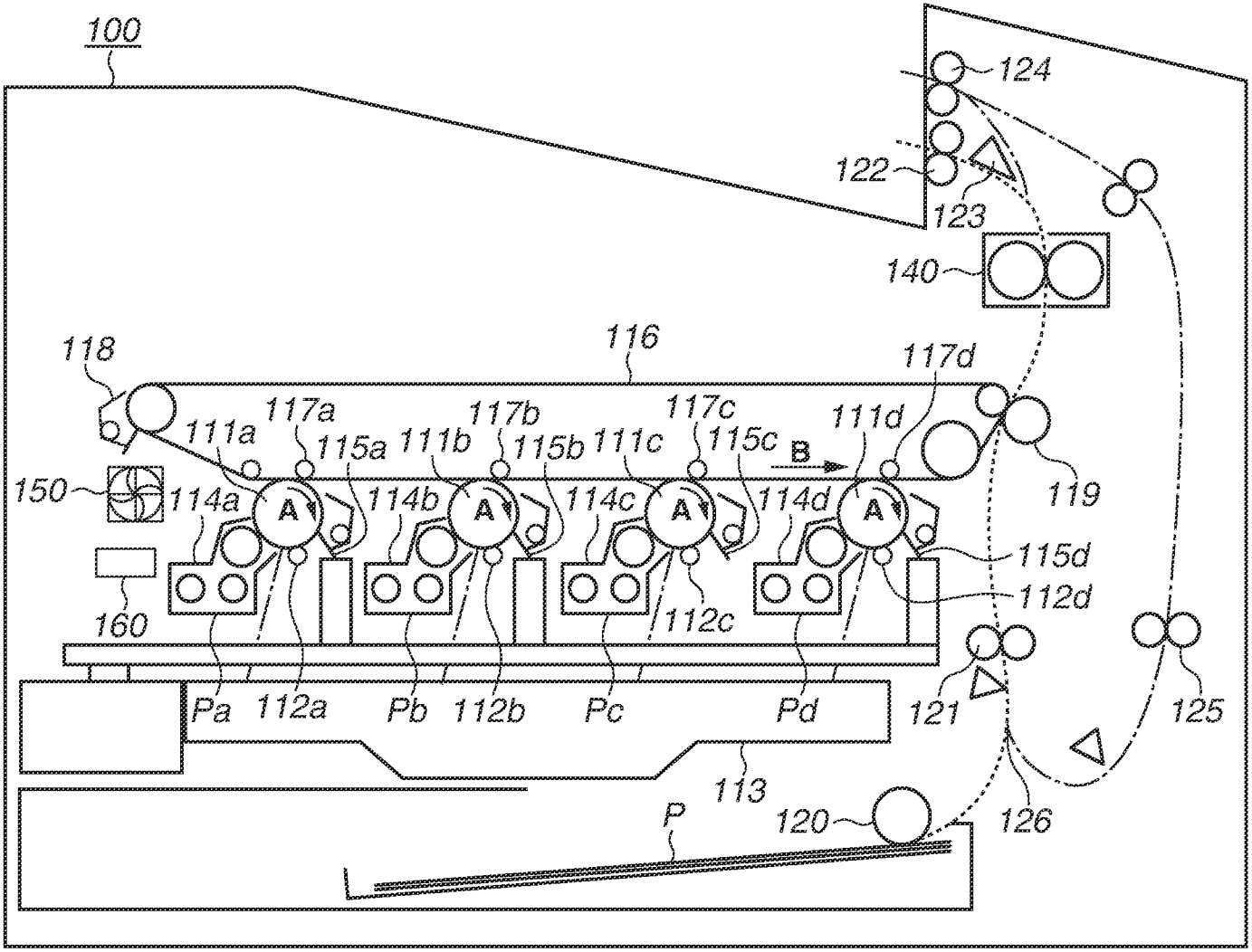
FIG. 1 is a diagram illustrating an internal structure of an image forming apparatus.

FIG. 1 is a diagram illustrating an internal structure of an image forming apparatus 100 according to a first exemplary embodiment. Photosensitive drums 111*a*, 111*b*, 111*c*, and 111*d* illustrated in FIG. 1 correspond to yellow, magenta, cyan, and black, respectively. An exposure device 113 and a charging device 112*a* are disposed near the photosensitive drum 111*a*. The charging device 112*a* uniformly charges a surface of the photosensitive drum 111*a*, and the exposure device 113 projects a laser beam modulated based on image information to be recorded onto the charged surface of the photosensitive drum 111*a*. A development device 114*a* is disposed near the photosensitive drum 111*a*, and develops a latent image formed on the surface of the photosensitive drum 111*a* by the laser beam projected from the exposure device 113. A cleaning device 115*a* is disposed near the photosensitive drum 111*a*, and cleans and collects toner remaining on the surface of the photosensitive drum 111*a*. A portion near each of the photosensitive drums 111*b*, 111*c*, and 111*d* has a configuration similar to that of the photosensitive drum 11*a*, except for the color of toner in use and an irradiation position of the exposure device 113. A photosensitive drum 111, a charging device 112, a development device 114, and a cleaning device 115 form one unit for each of the colors, and the unit is referred to as a process unit.

An intermediate transfer belt 116 to which a toner image on the photosensitive drum 111 is to be transferred is disposed above the photosensitive drum 111. On an inner side of the intermediate transfer belt 116, primary transfer rollers 117*a*, 117*b*, 117*c*, and 117*d* are each disposed at a position facing the corresponding photosensitive drum 111. A belt cleaning device 118 is disposed near the intermediate transfer belt 116, and collects the toner remaining on a surface of the intermediate transfer belt 116. A secondary transfer roller 119 is disposed near the intermediate transfer belt 116 on a side opposite to the belt cleaning device 118.

A recording sheet P is fed by a sheet feeding roller 120 connected to a sheet feeding motor (not illustrated). The fed recording sheet P is conveyed on a single-sided conveyance path (broken line in FIG. 1) to a transfer position between the intermediate transfer belt 116 and the secondary transfer roller 119 via a registration roller 121 that corrects skew. A fixing device 140 and a sheet discharge roller 122 are disposed on a downstream side in a direction of conveying the recording sheet P that has passed the transfer position.

In a case where two-sided printing is performed, the recording sheet P having an image fixed onto a front side or a back side thereof by passing through the fixing device 140 is conveyed on a double-sided conveyance path (dot-and-dash line in FIG. 1) after the conveyance path thereof is switched by a reversing flapper 123 and the recording sheet P is reversed by a reversing roller 124. Upon passing through a double-sided roller 125, the recording sheet P passes through a confluence portion 126 of the single-sided conveyance path and the double-sided conveyance path and is subsequently conveyed to the transfer position via the registration roller 121 again.

The process unit including the photosensitive drum 111 described above affects image quality depending on an in-apparatus temperature, i.e., the temperature in the image forming apparatus 100. The in-apparatus temperature also affects a durability life of the photosensitive drum 111. The ambient temperature of the process unit is controlled to be in a predetermined target-temperature range during printing. Thus, a fan unit 150 is disposed to generate airflow in and around the process unit. The fan unit 150 includes a fan 151 that cools internal devices of the image forming apparatus 100, and a motor 152 as a drive source that rotates the fan 151. Further, a temperature sensor 160 is disposed near the process unit to detect the ambient temperature of the process unit.

Figure 2:
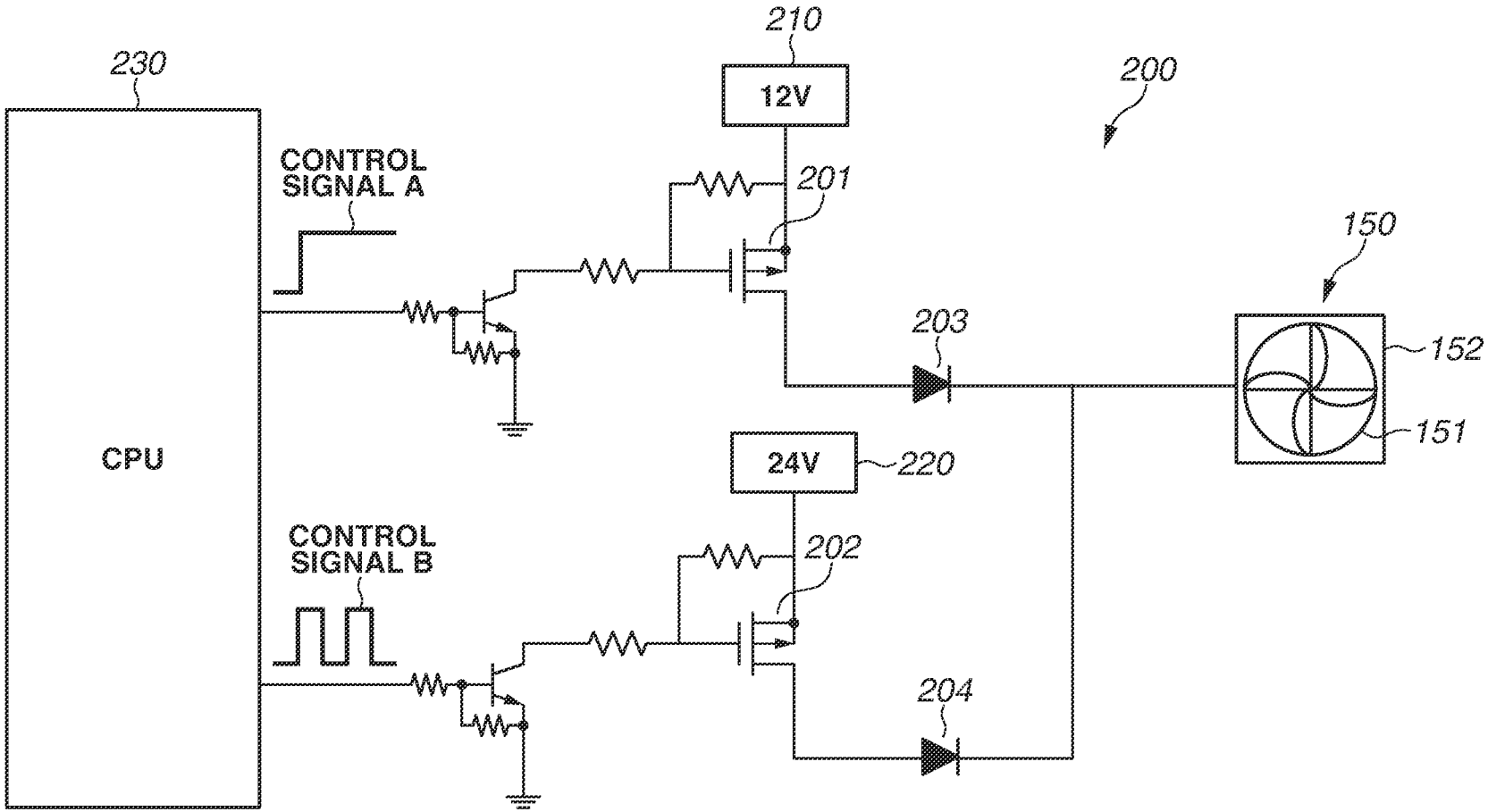
FIG. 2 is a diagram illustrating details of a control circuit of a fan unit according to a first exemplary embodiment.

The control circuit 200 of the fan unit 150 will be described below with reference to FIG. 2. The fan unit 150 includes the fan 151 that cools the internal devices (such as the photosensitive drums 111 and the fixing device 140) of the image forming apparatus 100, and the motor 152 as the drive source that rotates the fan 151.

The motor 152 is a direct current (DC) motor, and the number of revolutions varies depending on a supplied voltage. The motor 152 according to the present exemplary embodiment is supplied with a voltage of 12 V and a voltage of 24 V. The motor 152 rotates at full speed when the motor 152 is supplied with the voltage of 24 V, and rotates at half speed when the motor 152 is supplied with the voltage of 12 V. Further, in the present exemplary embodiment, the motor 152 can rotate at a speed between the full speed and the half speed by performing pulse-width modulation (PWM) control of the voltage of 24 V. The voltage to be supplied to the motor 152 is not limited to 12 V and 24 V.

A field effect transistor (FET) 201 is disposed between a power supply unit (first power supply unit) 210 that outputs 12 V and the motor 152. An FET 202 is disposed between a power supply unit (second power supply unit) 220 that outputs 24 V and the motor 152. The FET 201 turns on and off the voltage output by the power supply unit 210. The FET 202 turns on and off the voltage output by the power supply unit 220.

Further, in the present exemplary embodiment, diodes 203 and 204 are included so that, when only one of the voltage output from the power supply unit 210 and the voltage output from the power supply unit 220 is turned on, an electric current is prevented from flowing into a side that is turned off.

A central processing unit (CPU) (processor) 230 outputs a signal for turning on or off the FET (second switch) 201 and a signal for turning on or off the FET (first switch) 202. The CPU 230 according to the present exemplary embodiment controls a control signal B so that the control signal B repeats High and Low in order for the FET 202 to repeat turning on and off, while keeping the FET 201 in the on state (keeping a control signal A at High). Further, the CPU 230 can adjust the duty cycle of the High period of the control signal B.

Figure 3A:
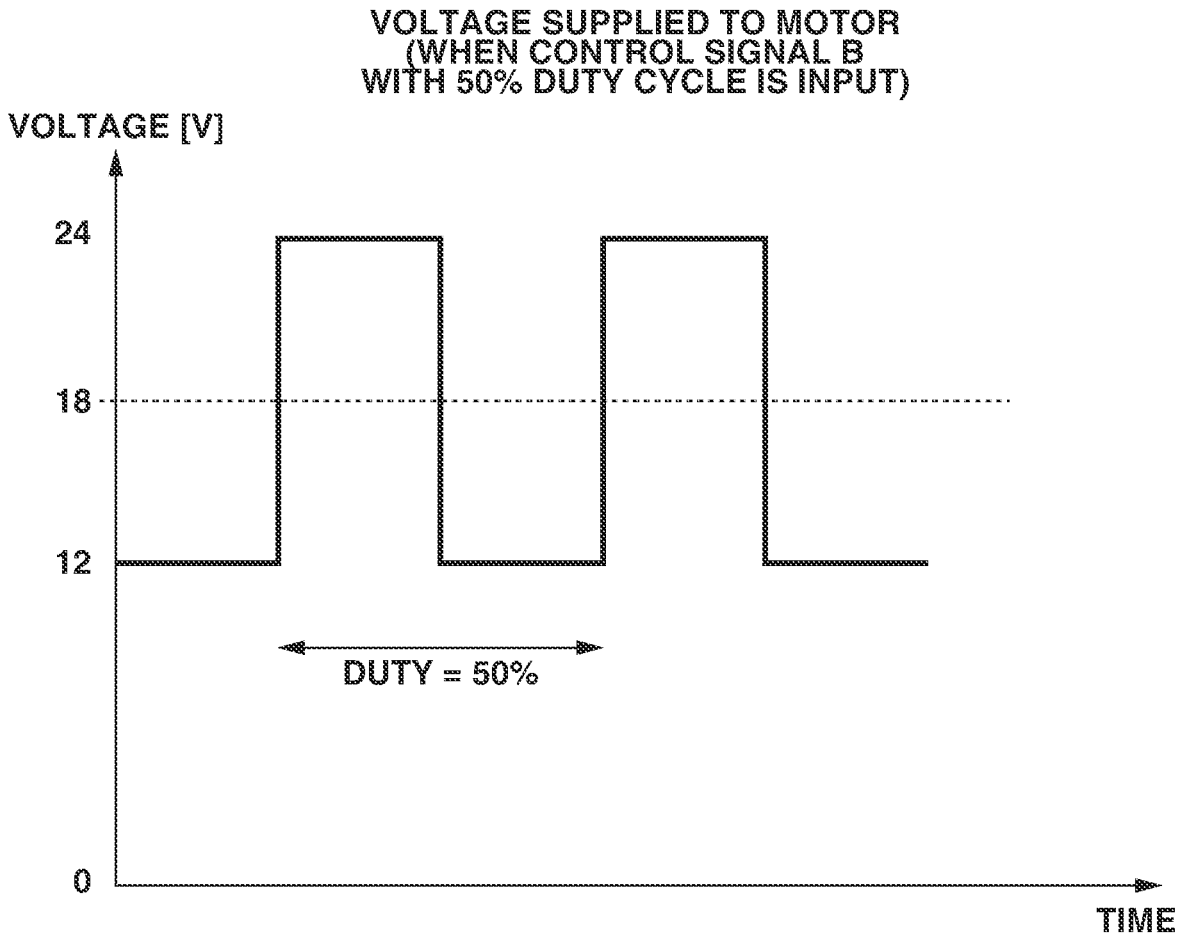
FIG. 3A is a diagram illustrating a voltage to be supplied to a motor.
Figure 3B:
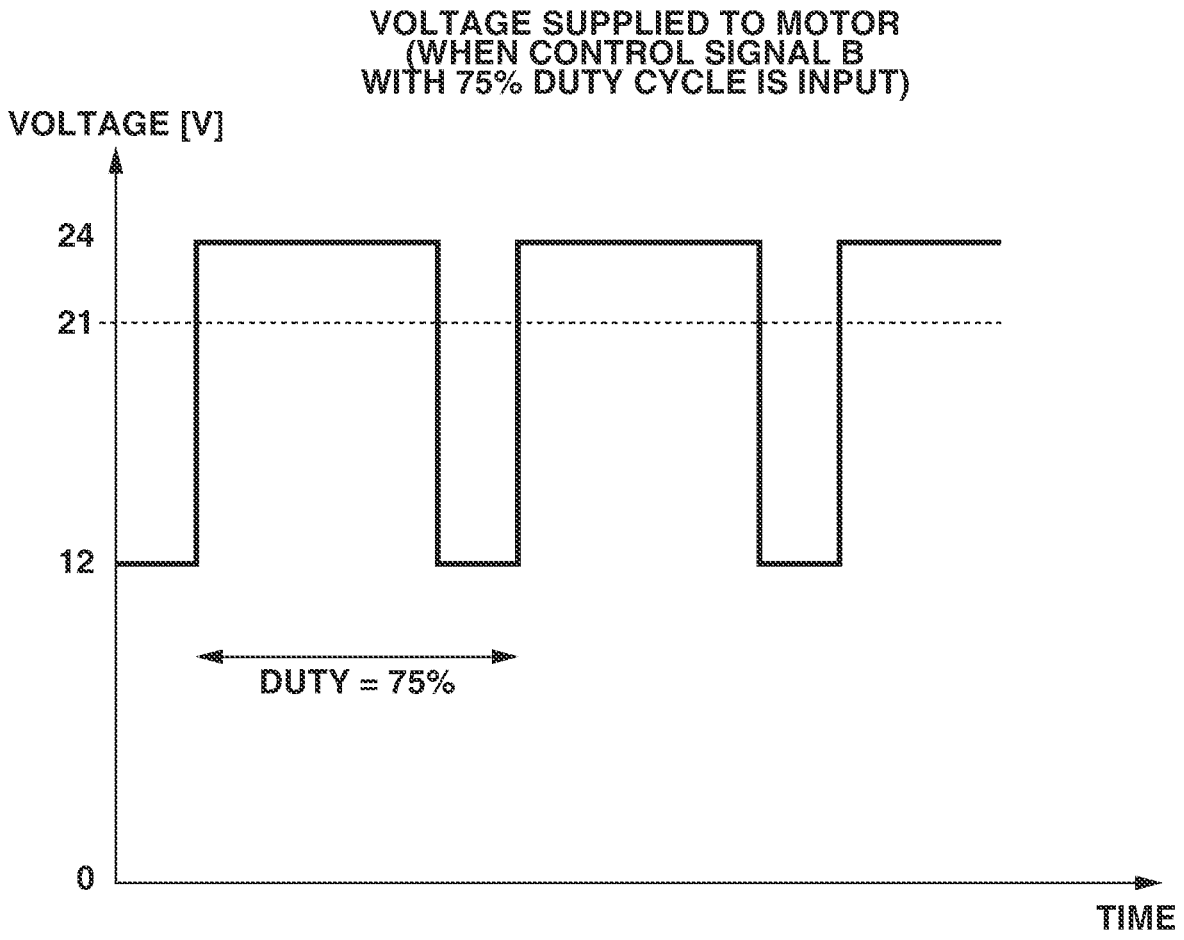
FIG. 3B is a diagram illustrating a voltage to be supplied to the motor.

FIG. 3A and FIG. 3B each illustrate a voltage to be supplied to the motor 152.

First, a method of supplying the voltage of 12 V or 24 V to the motor 152 will be described. In a case where the voltage of 12 V is supplied to the motor 152, the FET 201 in FIG. 2 is turned on and the FET 202 is turned off. Accordingly, the number of revolutions of the motor 152 is the half speed. In a case where the voltage of 24 V is supplied to the motor 152, the FET 202 in FIG. 2 is turned on and the FET 201 is turned off. Accordingly, the number of revolutions of the motor 152 is the full speed. The FET 201 may also be turned on.

Next, a method of supplying a voltage of 18 V to the motor 152 will be described. In a case where the voltage of 18 V is supplied to the motor 152, the FET 202 is turned on with a 50% duty cycle in a state where the FET 201 is turned on. The duty cycle according to the present exemplary embodiment is a proportion of a period during which the FET is turned on in a predetermined period. When the FET 202 is turned on with the 50% duty cycle, the voltage illustrated in FIG. 3A is supplied to the motor 152. The voltage supplied to the motor 152 toggles between 12 V and 24 V. The ratio between the period of 12 V and the period of 24 V is 1:1, and an average of the voltages supplied to the motor 152 is 18 V.

Next, a method of supplying a voltage of 21 V to the motor 152 will be described. In a case where the voltage of 21 V is supplied to the motor 152, the FET 202 is turned on with a 75% duty cycle in the state where the FET 201 is turned on. The duty cycle according to the present exemplary embodiment is the proportion of a period during which the FET is turned on in a predetermined period. When the FET 202 is turned on with the 75% duty cycle, the voltage illustrated in FIG. 3B is supplied to the motor 152. The voltage supplied to the motor 152 toggles between 12 V and 24 V. The ratio between the period of 12 V and the period of 24 V is 1:3, and the average of the voltages supplied to the motor 152 is 21 V.

Figure 4:
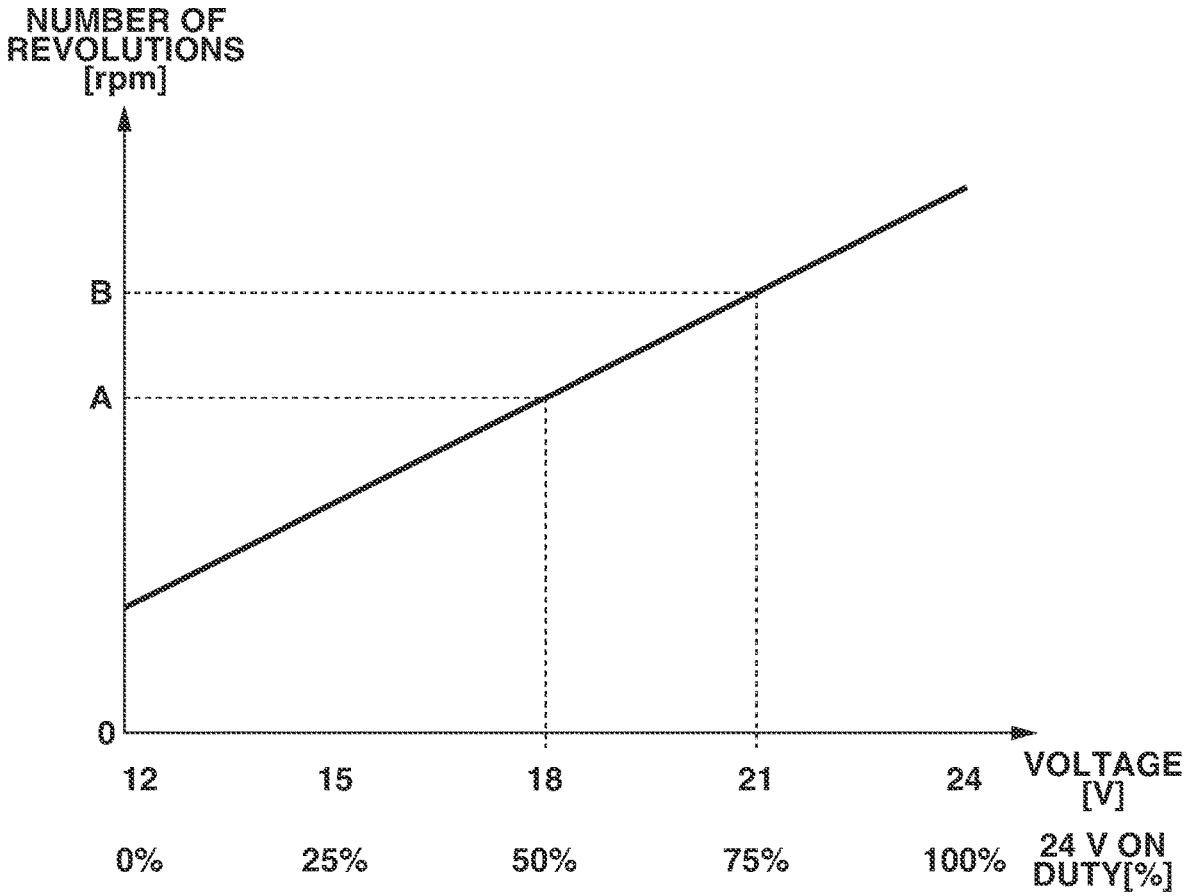
FIG. 4 is a diagram illustrating a relationship between a voltage supplied to the motor (duty cycle) and the number of revolutions of the motor.

As described above, the voltage between 12 V and 24 V can be variably supplied to the motor 152 by repeating turning on and off of the FET 202 in the state where the FET 201 is turned on. FIG. 4 is a diagram illustrating a relationship between the voltage supplied to the motor 152 (duty cycle) and the number of revolutions of the motor 152. In the motor 152 according to the present exemplary embodiment, the number of revolutions increases in proportion to the supplied voltage.

In the present exemplary embodiment, the FET 201 is in the on state while turning on and off of the FET 202 is repeated. Because the FET 201 is turned on, the lower limit of the voltage supplied to the motor 152 is 12 V, and the voltage to be supplied to the motor 152 changes between 12 V and 24 V. Compared with a case where the voltage to be supplied to the motor 152 changes between 0 V and 24 V, the change of the voltage is small, and thus fluctuation of the number of revolutions of the motor 152 is also small. Thus, generation of sound and generation of vibration due to rotation of the fan 151 can be suppressed.

In the present exemplary embodiment, the FET 201 is in the on state while turning on and off of the FET 202 is repeated, but the FET 201 may also be in the off state. In a case where the voltage of 18 V is supplied to the motor 152 without turning on the FET 201, the FET 202 is turned on with the 75% duty cycle. In a case where the voltage of 21

V is supplied to the motor 152 without turning on the FET 201, the FET 202 is turned on with an 87.5% duty cycle.

Figure 5:
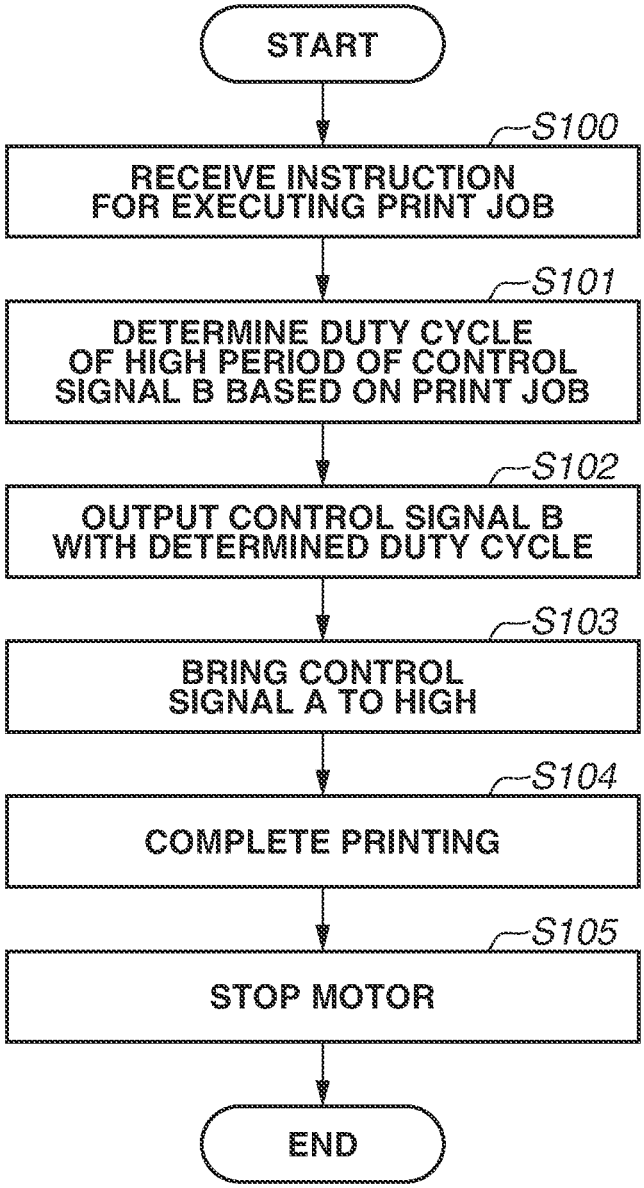
FIG. 5 is a flowchart illustrating control of a fan.

The control of the fan 151 will be described below with reference to FIG. 5.

First, the image forming apparatus 100 receives a print job from an external apparatus. Upon receiving an instruction for executing the received print job, the image forming apparatus 100 starts printing. In step S100, the CPU 230 receives the instruction for executing the print job. Subsequently, in step S101, the CPU 230 determines the duty cycle of the High period of the control signal B based on the print job.

A condition that changes the in-apparatus temperature such as a rotation speed of a conveyance motor for conveying a recording medium such as paper or a fixing temperature of the fixing device 140 is determined based on the content of the print job. Thus, in the present exemplary embodiment, the CPU 230 determines the duty cycle of the High period of the control signal B based on the content of the print job. For example, the CPU 230 determines the duty cycle of the High period of the control signal B based on a size of the recording medium to be used for printing. In a case where the recording medium is long, the CPU 230 increases the number of revolutions of the fan 151 by increasing the duty cycle of the High period of the control signal B. In a case where the recording medium is thick, the CPU 230 increases the number of revolutions of the fan 151 by increasing the duty cycle of the High period of the control signal B. Further, the CPU 230 determines the duty cycle of the High period of the control signal B based on a basis weight of the recording medium.

Subsequently, in step S102, the CPU 230 outputs the control signal B with the determined duty cycle. Accordingly, the FET 202 is turned on and off based on the control signal B. In step S103, the CPU 230 brings the control signal A to High. Accordingly, the FET 201 is turned on based on the control signal A. The control signal B is output with the determined duty cycle in step S102, but the control signal B may be fixed to High or may be fixed to Low depending on the content of the print job.

Thus, the FET 202 that supplies the voltage of 24 V to the motor 152 is turned off and on repeatedly, so that the voltage of 24 V or less can be variably supplied to the motor 152. Accordingly, the number of revolutions of the fan 151 rotated by the motor 152 can be finely adjusted.

In addition, fluctuation of the voltage to be supplied to the motor 152 can be reduced by turning on the FET 201 that supplies the voltage of 12 V to the motor 152, while repeatedly turning on and off the FET 202. As a result, the fluctuation of the number of revolutions of the motor 152 is also reduced, so that the generation of sound and the generation of vibration due to the rotation of the fan 151 can be suppressed.

In step S104, the CPU 230 completes printing. Subsequently, in step S105, the CPU 230 stops the motor 152 by bringing the control signals A and B to Low. The condition for stopping the motor 152 may not be the completion of printing. For example, the condition may be a state where a temperature indicated by temperature data output by the temperature sensor 160 is a target temperature or less, and the motor 152 may be stopped if this condition is satisfied. Further, the motor 152 may be stopped after a lapse of a predetermined time from the completion of printing.

Second Exemplary Embodiment

Figure 6:
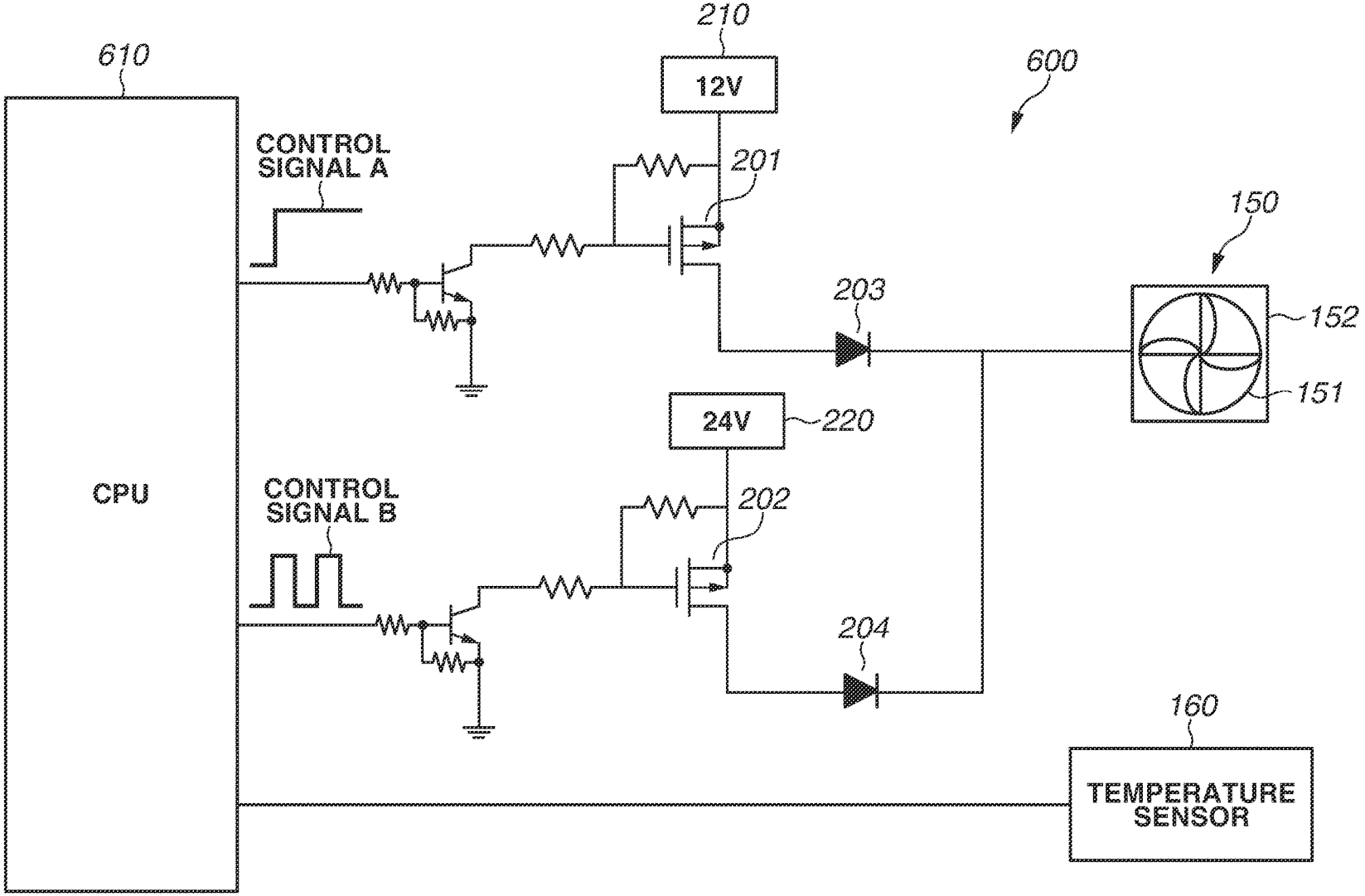
FIG. 6 is a diagram illustrating details of a control circuit of a fan unit according to a second exemplary embodiment.

FIG. 6 is a diagram illustrating details of a control circuit 600 of the fan unit 150 according to a second exemplary embodiment. The control circuit 600 of the fan unit 150 will be described below with reference to FIG. 6. The control circuit 600 is similar to the control circuit 200 except that the temperature data output by the temperature sensor 160 is used.

A CPU 610 of the control circuit 600 controls the rotation speed of the motor 152 based on the temperature data output by the temperature sensor 160. The temperature sensor 160 is disposed near process parts with severe temperature restrictions such as the photosensitive drum 111. The temperature sensor 160 outputs the temperature data having an analog value corresponding to a sensed temperature to the CPU 610. The CPU 610 adjusts the duty cycle of the High period of the control signal B based on the temperature data output by the temperature sensor 160.

For example, the CPU 610 increases the duty cycle of the High period of the control signal B if the temperature data output by the temperature sensor 160 is higher than a target temperature. The CPU 610 decreases the duty cycle of the High period of the control signal B if the temperature data output by the temperature sensor 160 is lower than a target temperature.

Figure 7:
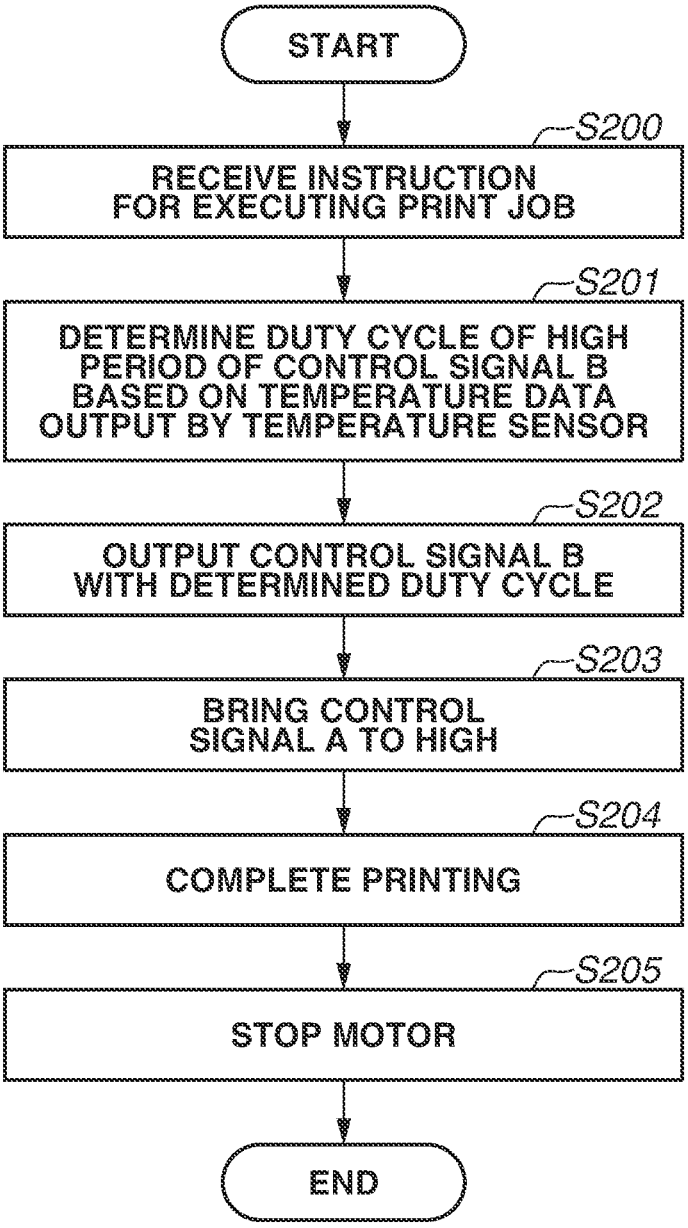
FIG. 7 is a flowchart illustrating control of a fan according to the second exemplary embodiment.

FIG. 7 is a flowchart illustrating control of the fan 151 according to the second exemplary embodiment. The control of the fan 151 will be described below with reference to FIG. 7.

First, the image forming apparatus 100 receives a print job from an external apparatus. Upon receiving an instruction for executing the received print job, the image forming apparatus 100 starts printing. In step S200, the CPU 610 receives the instruction for executing the print job. Subsequently, in step S201, the CPU 610 determines the duty cycle of the High period of the control signal B based on the temperature data output by the temperature sensor 160.

Subsequently, in step S202, the CPU 610 outputs the control signal B with the determined duty cycle. Accordingly, the FET 202 is turned on and off based on the control signal B. In step S203, the CPU 610 brings the control signal A to High. Accordingly, the FET 201 is turned on based on the control signal A. Steps thereafter are similar those of the first exemplary embodiment and therefore will not be described.

In the second exemplary embodiment, the duty cycle of the High period of the control signal B may be regularly adjusted based on the temperature data output by the temperature sensor 160. In this way, the number of revolutions of the fan 151 can be finely controlled based on the temperature data output by the temperature sensor 160.

Third Exemplary Embodiment

In the above-described exemplary embodiments, the example in which the present disclosure is applied to the image forming apparatus is described, but application targets of the present disclosure are not limited to the image forming apparatus. The present disclosure is applicable to an information processing apparatus such as a personal computer (PC) or a server including a motor that rotates a head of a hard disk drive (HDD), an air conditioner (indoor unit) including a motor that drives a fan, and an automobile.

In the first exemplary embodiment, the duty cycle of the High period of the control signal B is determined based on the content of the print job. In the second exemplary embodiment, the duty cycle of the High period of the control signal B is determined based on the temperature data output by the temperature sensor. The duty cycle of the High period of the control signal B may be adjusted based on the temperature data output by the temperature sensor after the duty cycle of the High period of the control signal B is determined based on the content of the print job.

In each of the above-described exemplary embodiments, the present disclosure is applied to the motor that rotates the fan, but the scope of applications of the present disclosure is not limited to the motor that rotates the fan. For example, the present disclosure may be applied to a motor for conveying paper and may be applied to a fan that cools a processor.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-180373, filed Sep. 30, 2019, which is hereby incorporated by reference herein in its entirety.

What is claimed is:

1. An electronic apparatus comprising:

a motor capable of controlling rotation speed;

a first power supply unit configured to supply a first voltage to the motor;

a second power supply unit configured to supply a second voltage higher than the first voltage to the motor; and a controller capable of controlling at least the rotation speed of the motor to a first speed, a second speed slower than the first speed, and a third speed slower than the second speed; and a first switch between the motor and the second power supply unit, wherein the controller controls the rotation speed of the motor to the first speed by supplying power to the motor from at least the second power supply unit, wherein the controller controls the rotation speed of the motor to the third speed by supplying power to the motor from the first power supply unit and not supplying power to the motor from the second power supply unit, and wherein the controller controls the rotation speed of the motor to the second speed by controlling duty cycle of the second power supply unit and supplying power to the motor from the second power supply unit, wherein the controller controls the duty cycle of the second power supply unit by turning on and off the first switch.

2. The electronic apparatus according to claim 1, wherein controller controls the duty cycle of the second power supply unit to the motor while maintaining the supply of the first voltage from the first power supply unit to the motor.

3. The electronic apparatus according to claim 1, further comprising a second switch between the first power supply unit and the motor, wherein the controller supplies power to the motor from the first power supply unit by turning on the second switch.

4. The electric apparatus according to claim 3, further comprising:

a first diode arranged between the motor and the first switch so that a current does not flow from the motor to the first switch; and a second diode arranged between the motor and the second switch so that a current does not flow from the motor to the second switch.

5. The electronic apparatus according to claim 1, further comprising a fan, wherein the motor rotates the fan.

6. The electronic apparatus according to claim 5, wherein the fan cools an internal device of the electronic apparatus.

7. The electronic apparatus according to claim 1, further comprising a process unit configured to print an image on a recording medium.

8. The electronic apparatus according to claim 1, wherein based on content of a received print job, the processor determines the duty cycle.

9. The electronic apparatus according to claim 8, wherein the content of the received print job is at least one of a size and a basis weight of a recording medium to be used for printing.

10. The electronic apparatus according to claim 1, further comprising a temperature sensor, wherein based on temperature data output by the temperature sensor, the processor determines the duty cycle.

11. The electric apparatus according to claim 1, wherein the controller repeats supplying and stopping power from the second power supply unit to the motor at a predetermined periodicity to control the duty cycle.

12. The electric apparatus according to claim 1, wherein the duty cycle is 50%.

13. The electric apparatus according to claim 1, wherein the duty cycle is 75%.

* * * * *